US012497773B1

(12) United States Patent
Adames T

(10) Patent No.: US 12,497,773 B1
(45) Date of Patent: Dec. 16, 2025

(54) DEPLOYABLE EXTENDER ASSEMBLY

(71) Applicant: Francisco A Adames T, Hialeah, FL (US)

(72) Inventor: Francisco A Adames T, Hialeah, FL (US)

( * ) Notice: Subject to any disclaimer, the term of this patent is extended or adjusted under 35 U.S.C. 154(b) by 0 days.

(21) Appl. No.: 19/281,605

(22) Filed: Jul. 26, 2025

(51) Int. Cl.
*E04B 1/21* (2006.01)

(52) U.S. Cl.
CPC ..... *E04B 1/215* (2013.01)

(58) Field of Classification Search
CPC ..... E04B 1/215; E04B 1/483; E04B 1/4114; E04B 1/2403; E04B 2001/2415
See application file for complete search history.

(56) References Cited

U.S. PATENT DOCUMENTS 1,872,813 A * 8/1932 Reiland ..... E04B 1/4135 52/379
3,513,610 A * 5/1970 Devonport ..... B28B 23/00 52/283
3,715,850 A * 2/1973 Chambers ..... E04F 13/0855 52/235
3,733,757 A * 5/1973 Scott ..... E04B 1/215 52/250
4,226,068 A * 10/1980 Wadsworth ..... E04F 13/0871 403/379.5
4,531,334 A * 7/1985 Nylander ..... E04B 1/98 52/109
4,903,448 A * 2/1990 Compton ..... E04B 1/215 52/250
4,951,438 A * 8/1990 Thoresen ..... F16B 7/22 52/283
4,964,775 A * 10/1990 Youmans ..... E04G 21/161 414/12
5,386,675 A * 2/1995 Baur ..... E04B 1/215 52/223.13
5,548,939 A * 8/1996 Carmical ..... E04B 1/4135 52/707
5,711,122 A * 1/1998 Lee ..... E04G 17/16 52/707
5,711,504 A * 1/1998 Cusimano ..... B60S 9/08 248/354.3
5,862,634 A * 1/1999 Berger ..... E04F 11/022 52/79.9

(Continued)

*Primary Examiner* — James M Ference
(74) *Attorney, Agent, or Firm* — Ruben Alcoba, ESQ.

(57) ABSTRACT

A deployable extender assembly is provided for the edge of a load-carrying member in a structural system to improve performance and constructability. The assembly includes a strut-and-tie system movable between a stowed position and an extended position. In the extended position, the strut-and-tie system transfers load from the load-carrying member to a support member through a bearing surface. The bearing surface is configured to align its centroid with that of the support member to eliminate or reduce eccentricity and the resulting undesired flexural stresses. The assembly may include mechanical integration with internal reinforcement, such as prestressing strands or steel bars, and may incorporate bearing plates, elastomeric pads, or a combination thereof. A cavity in the support member accommodates the assembly in its extended position and allows movement between positions. The system enhances installation in constrained spaces and may be actuated remotely to facilitate deployment where access is limited.

2 Claims, 12 Drawing Sheets

(56) References Cited

U.S. PATENT DOCUMENTS 7,497,014 B2 * 3/2009 Muller ..... F16C 29/02 384/42
7,775,478 B2 * 8/2010 Wood ..... B64C 1/068 52/246
8,209,925 B2 * 7/2012 Foley ..... E04B 1/2403 403/403
8,950,133 B2 * 2/2015 Hansort ..... E04B 1/215 52/707
10,233,630 B1 * 3/2019 Francies, III ..... E04B 1/2608
10,370,845 B2 * 8/2019 Francies, III ..... E04B 1/483
10,883,265 B2 * 1/2021 Kelly ..... E04B 1/4114
11,492,797 B2 * 11/2022 Recker ..... E04B 1/4114
2003/0131547 A1 * 7/2003 Woodruff, III ..... E04B 1/215 52/283
2003/0167723 A1 * 9/2003 Reichartz ..... E04C 3/29 52/655.1
2005/0223659 A1 * 10/2005 Berg ..... E04B 1/36 52/146
2007/0039258 A1 * 2/2007 Walker, III ..... E04B 2/96 52/235
2008/0107480 A1 * 5/2008 Berg ..... E04B 1/215 403/293
2008/0279620 A1 * 11/2008 Berg ..... F16B 7/042 403/178
2009/0165413 A1 * 7/2009 Berg ..... E04B 1/215 52/327
2010/0192484 A1 * 8/2010 Berg ..... E04B 1/483 52/125.4
2010/0313518 A1 * 12/2010 Berg ..... E04B 1/215 52/707
2011/0107716 A1 * 5/2011 Foley ..... E04B 1/2403 52/699
2019/0119908 A1 * 4/2019 Petricca ..... E04B 1/41
2023/0003024 A1 * 1/2023 Kang ..... E04B 1/215

* cited by examiner

DEPLOYABLE EXTENDER ASSEMBLY

BACKGROUND

The present invention relates to structural systems used in construction, and more specifically to a deployable extender assembly located at the edge of a load-carrying member. The invention improves structural performance and constructability by enabling efficient and adaptable load transfer to a supporting member, particularly in spatially constrained conditions.

In reinforced concrete, steel, and composite structural systems, transferring loads from load-carrying members—such as beams, trusses, or walls—to support members—such as columns, walls, or beams—is a fundamental aspect of structural design. Typically, this load transfer occurs through bearing interfaces or mechanical connections located at or near the edge of the load-carrying member.

A recurring challenge in such systems involves eccentricity between the centroid of the bearing surface and the centroid of the support member. This eccentricity introduces undesired flexural stresses in the support member in addition to the axial loads. These flexural stresses are well understood and are typically taken into account during structural design. However, the eccentricity is often difficult or impractical to eliminate using conventional systems, particularly in cases where spatial constraints or standard geometry prevent alignment between the bearing and support centroids.

Although these flexural demands are designed for, they add complexity and material demand to the support member. Therefore, if the eccentricity could be eliminated—or substantially reduced—these undesired flexural stresses could be avoided, allowing the support member to be optimized for axial loading. This would simplify design, reduce reinforcement requirements, and improve overall structural efficiency.

In addition to the issue of eccentricity, constructability remains a critical concern. Traditional fixed or rigid bearing connections are not easily adjustable once installed and offer limited flexibility in terms of installation sequence or configuration. In complex or tight construction environments, this inflexibility can lead to misalignment, labor-intensive workarounds, and construction delays.

Most conventional systems also lack deployability. That is, they are not designed to move from a stowed to an extended position during construction. This limits their usefulness in staged erection or retrofit applications, where temporary clearances and late-stage deployment may be required.

Furthermore, while many systems rely on anchorage to concrete alone—which is often structurally sufficient—there are circumstances where direct mechanical integration with internal reinforcement, such as prestressing strands or steel rebars, can offer additional performance or constructability benefits. The present invention allows for such integration when needed but does not suggest that current systems are inherently deficient for not doing so.

Lastly, access for installation is a frequent constraint. When connection points are located deep within a structural system or behind formwork, traditional systems that require direct manual access become difficult to install. Most lack features for guided or remote deployment that would address this challenge.

In summary, the present invention addresses several limitations found in conventional systems: (a) eccentric load transfer, which introduces undesired but expected and accounted—for flexural stresses in support members—eliminating such eccentricity allows for axial-load-optimized design; (b) limited constructability in tight or geometrically constrained environments; (c) lack of deployability, restricting construction sequencing and adaptability; (d) no option for reinforcement integration, where such integration could enhance performance in select applications; and (e) challenging access, due to absence of remote or guided deployment mechanisms.

The deployable extender assembly of the present invention offers a structurally efficient, adaptable, and space-conscious solution that facilitates more optimal load transfer and simplifies construction operations.

SUMMARY

The present invention provides a deployable extender assembly for the edge of a load-carrying member in a structural system. The assembly enhances both structural performance and constructability by enabling efficient load transfer to a support member while addressing spatial constraints and minimizing eccentricity between critical structural components.

The deployable extender assembly includes a strut-and-tie assembly that is movable between a stowed position and an extended position. The strut-and-tie assembly comprises a strut member and a tie member, connected at a strut-and-tie node. The strut member has a bearing end that transfers load to a load transfer assembly at the edge of the load-carrying member when in the extended position. The tie member has an anchor end that is pivotally connected to an anchor assembly fixed to the edge of the load-carrying member. This pivotal connection allows the strut-and-tie assembly to rotate or swing between positions, facilitating deployment in constrained construction environments.

In the extended position, the strut-and-tie assembly rests on a bearing surface of a support member. The bearing surface may be defined by a plain surface, an embedment, a steel bearing plate, an elastomeric bearing pad, or a combination of some of them. The centroid of the bearing surface is configured to align substantially with the centroid of the support member, thereby eliminating or significantly reducing eccentricity. This reduction in eccentricity prevents the introduction of undesired flexural stresses in the support member and allows the member to be optimized for axial loading, resulting in more efficient structural design.

A cavity formed within the support member receives the bearing section of the strut-and-tie assembly in its extended position and is shaped to accommodate the movement of the assembly between the stowed and extended configurations. This feature supports space-conscious deployment and protects components during installation.

In some embodiments, the deployable extender assembly includes mechanical integration with internal reinforcement of reinforced concrete members. The anchor assembly may be connected to prestressing reinforcement, such as strands gripped by barrel-wedge chucks and supported by strand yokes, or to steel reinforcement, such as rebars or flat bars, using dedicated yoke components. While this type of integration is not required for functionality, it may provide additional benefits for structural performance or ease of construction in certain scenarios.

Additional features may include pivot pins or headed bolts at joint locations, strut stiffeners to increase load capacity, and a rope-actuated access mechanism that enables remote or indirect deployment of the assembly when direct access is restricted.

The deployable extender assembly is suitable for various structural systems, including beams, lintels, trusses, and walls composed of concrete, steel, wood, or composites, and it can be used in conjunction with a range of support members such as columns, beams, and structural walls.

The primary objective of the invention is to provide a structural assembly that improves constructability and enables efficient, space-conscious load transfer while eliminating eccentricity between the bearing surface and the support member's centroid-thereby reducing undesired flexural stresses and allowing for the optimized design of the support member.

BRIEF DESCRIPTION OF THE DRAWINGS

These and other features, aspects, and advantages of the present invention will become better understood with regards to the following description, appended claims, and drawings where:

As seen in FIGS. 1-12B, the present invention is a deployable extender assembly 10 for an edge 101 of a load-carrying member 11 of a structural system 100 to enhance the performance and constructability of the structural system 100. The deployable extender assembly 10 comprises a strut-and-tie assembly 20 movable between a stowed position 102*a* and an extended position 102*b*, the strut-and-tie assembly 20 has a strut member 21 and a tie member 22 connected at a strut-and-tie node 107, the strut member 21 has a bearing end 103 positioned against a load transfer assembly 40 at the edge 101 of the load-carrying member 11 when the strut-and-tie assembly 20 is in the extended position 102*b*, the tie member 22 has an anchor end 104 articulately connected to an anchor assembly 50 fixedly secured to the edge 101 of the load-carrying member 11, the articulated connection enables the strut-and-tie assembly 20 to move between the stowed and extended positions (102*a*, 102*b*), the strut-and-tie assembly 20 defines a bearing section 60 that rests on a bearing surface 114 of a support member 12 of the structural system 100 in the extended position 102*b*. Wherein the strut-and-tie assembly 20 may be moved from the stowed position 102*a* to the extended position 102*b* in proximity to the bearing surface 114 to facilitate the accommodation of space constraints and thereby improve constructability. And, wherein the centroid of the bearing surface 114 may be located substantially at the centroid of the support member 12 to substantially eliminate flexural stresses along the support member 12 that result from eccentricity between the two centroids.

Figure 1B:
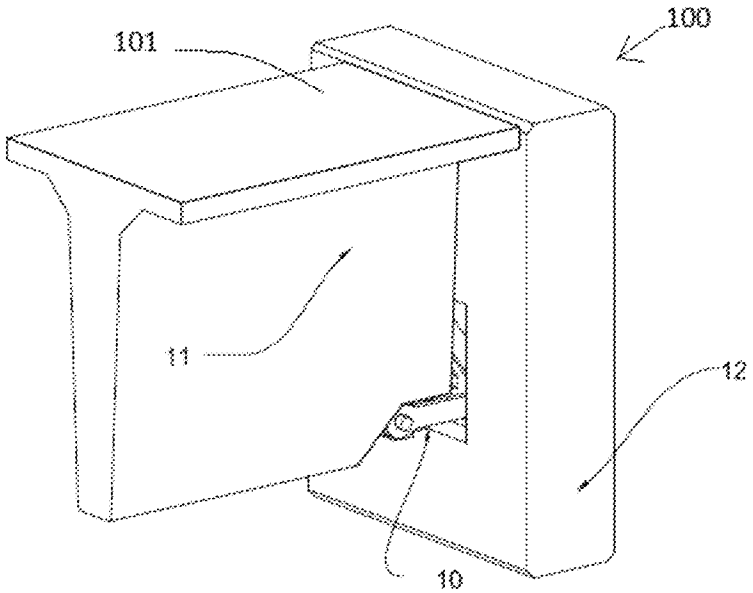
FIG. 1A, FIG. 1B, and FIG. 1C show three perspective views of the present invention.
Figure 1C:
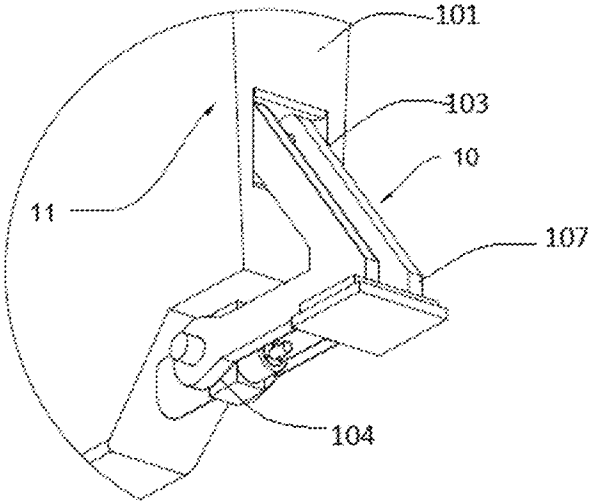
Figure 1A:
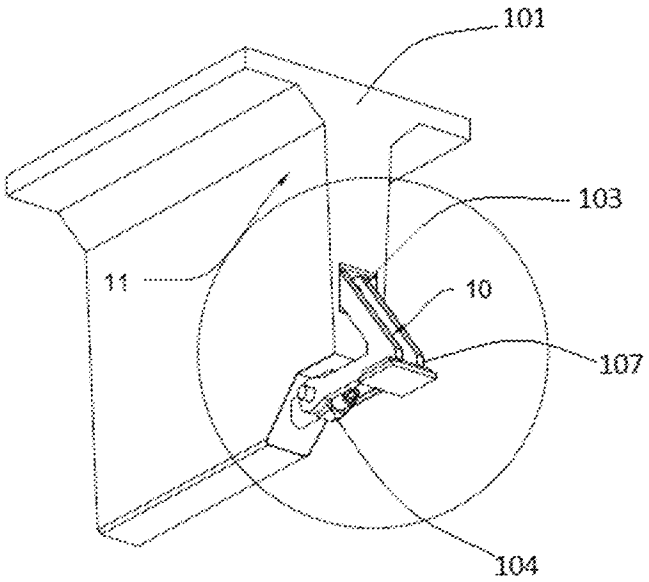
Figure 2:
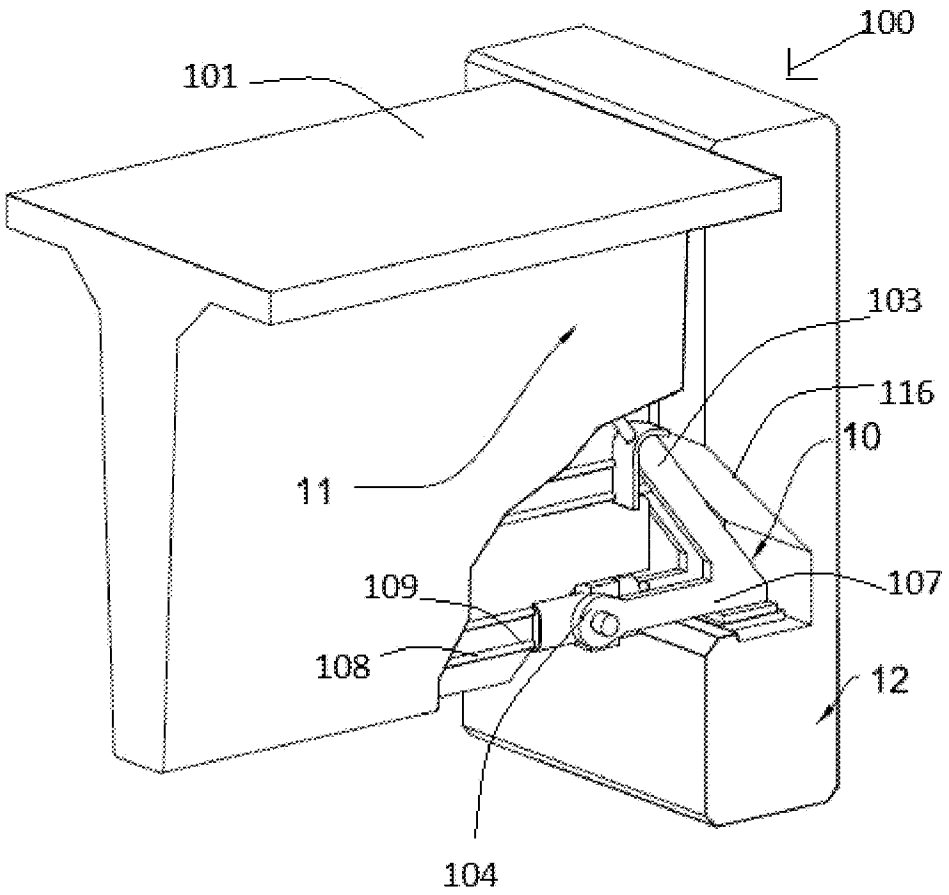
FIG. 2 shows a perspective view of the present invention that reveals the components embedded in the load-carrying member.
Figure 3:
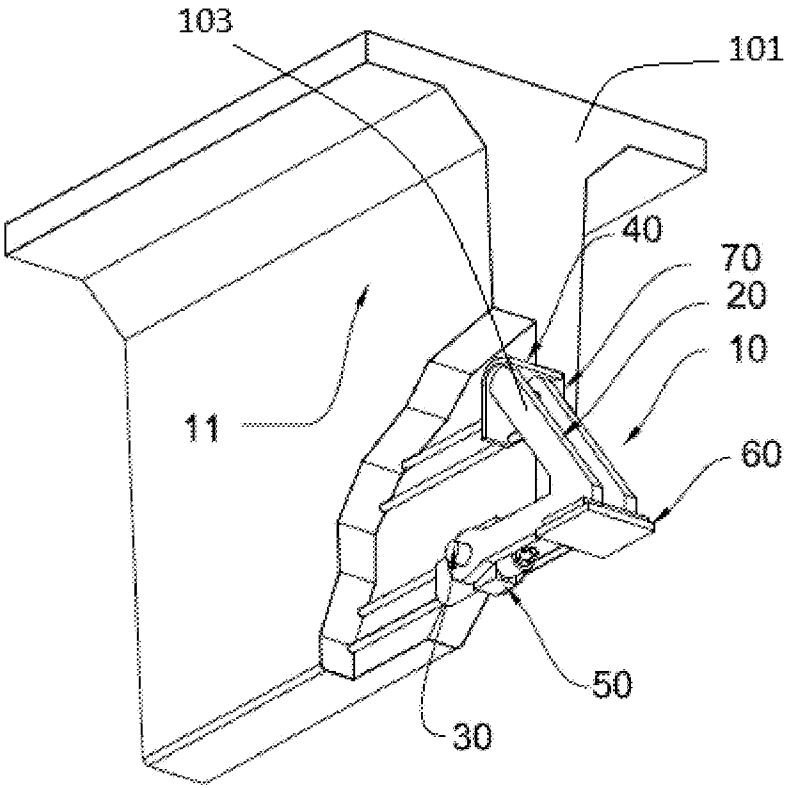
FIG. 3 shows a perspective view of the present invention that reveals the components embedded in the load-carrying member.
Figure 4:
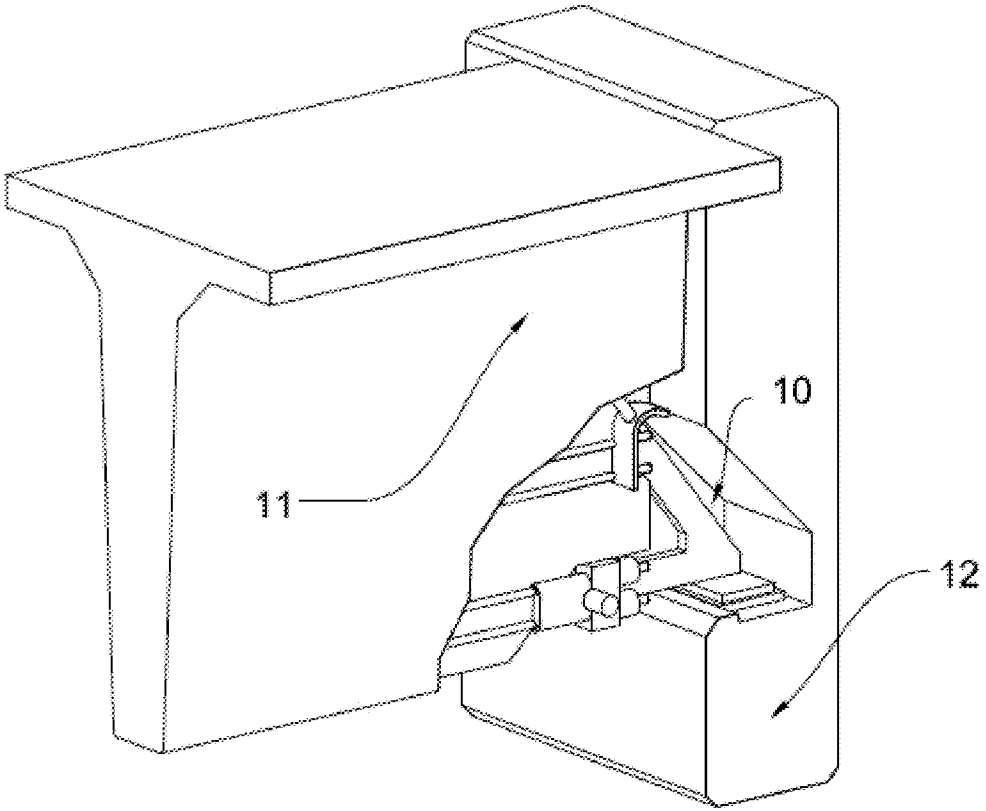
FIG. 4 shows a perspective view of the present invention that reveals the components embedded in the load-carrying member.
Figure 5:
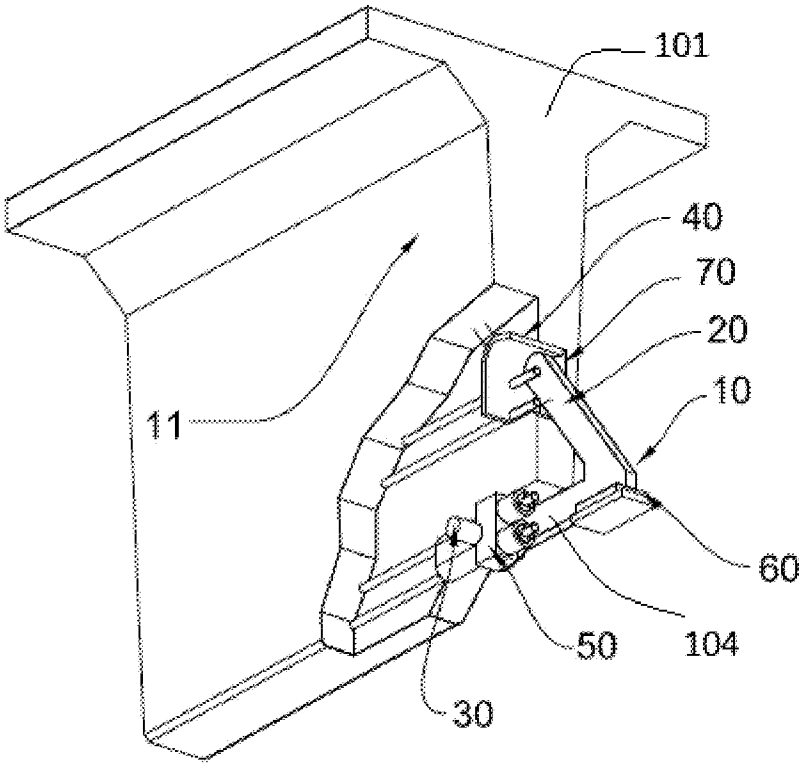
FIG. 5 shows a perspective view of the present invention that reveals the components embedded in the load-carrying member.
Figure 6A:
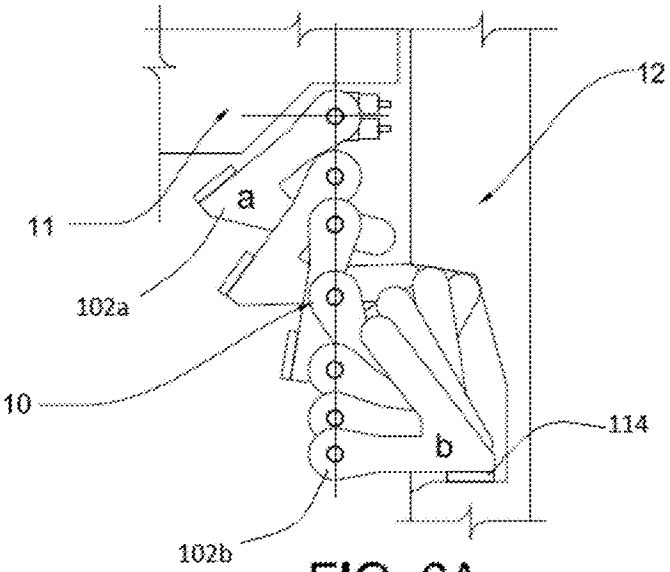
FIG. 6A and FIG. 6B show two cross sectional views of the present invention that depict the movement of the strut-and-tie assembly between the stowed and extended positions.
Figure 6B:
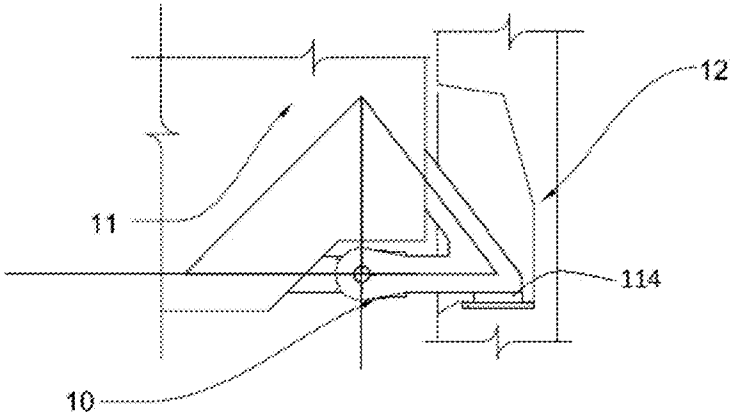
Figure 7B:
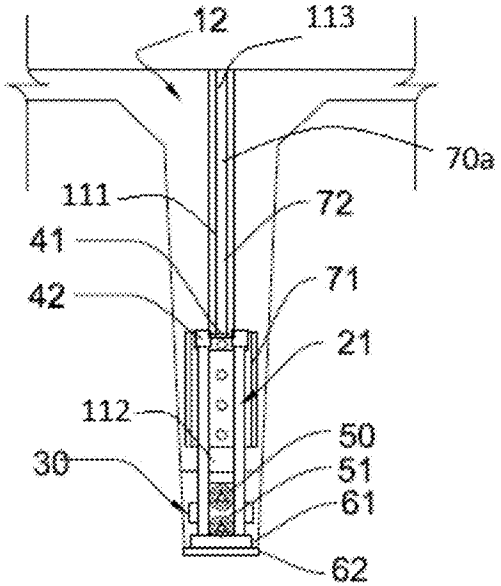
FIG. 7B, FIG. 7C, and FIG. 7D show two elevation views and two detailed views of embodiments of the present invention.
Figure 7D:
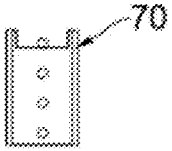
Figure 7A:
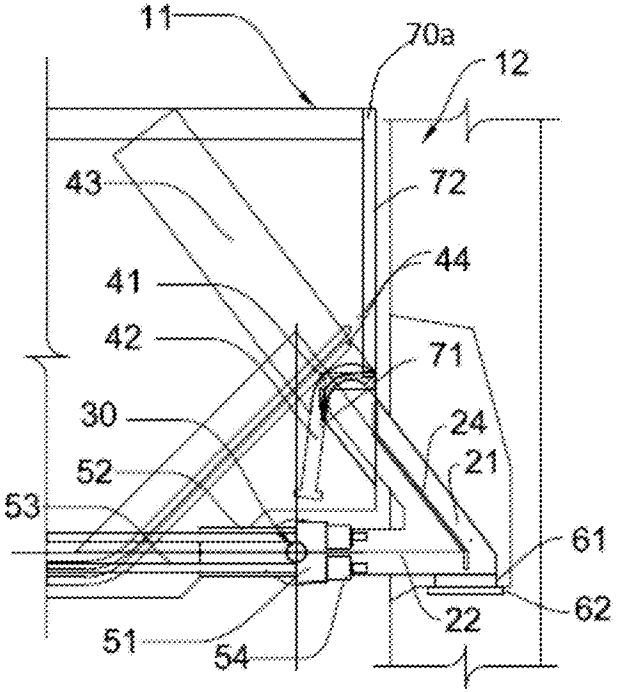
FIG. 7A.
Figure 7C:
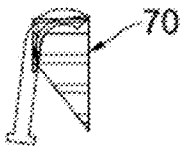
Figure 8:
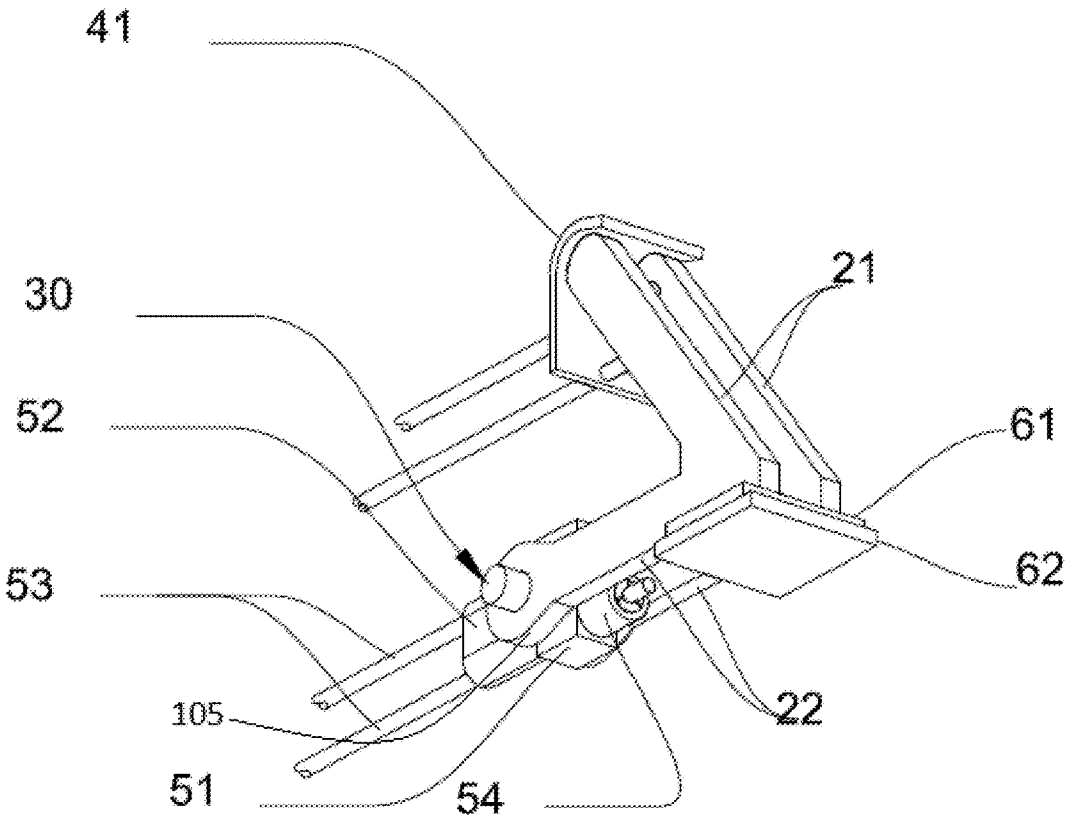
FIG. 8 shows a perspective view of the present invention without including the load-carrying and support members.
Figure 9:
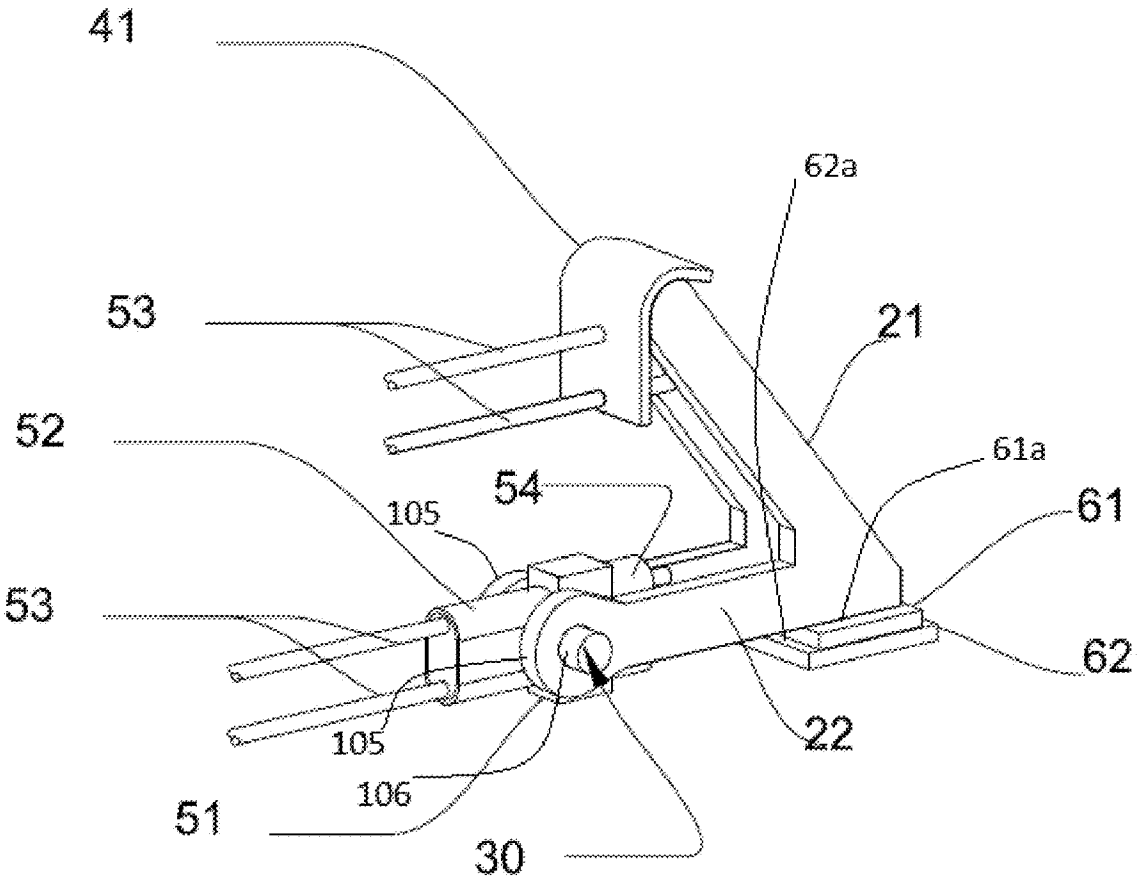
FIG. 9 shows a perspective view of the present invention without including the load-carrying and support members.
Figure 10:
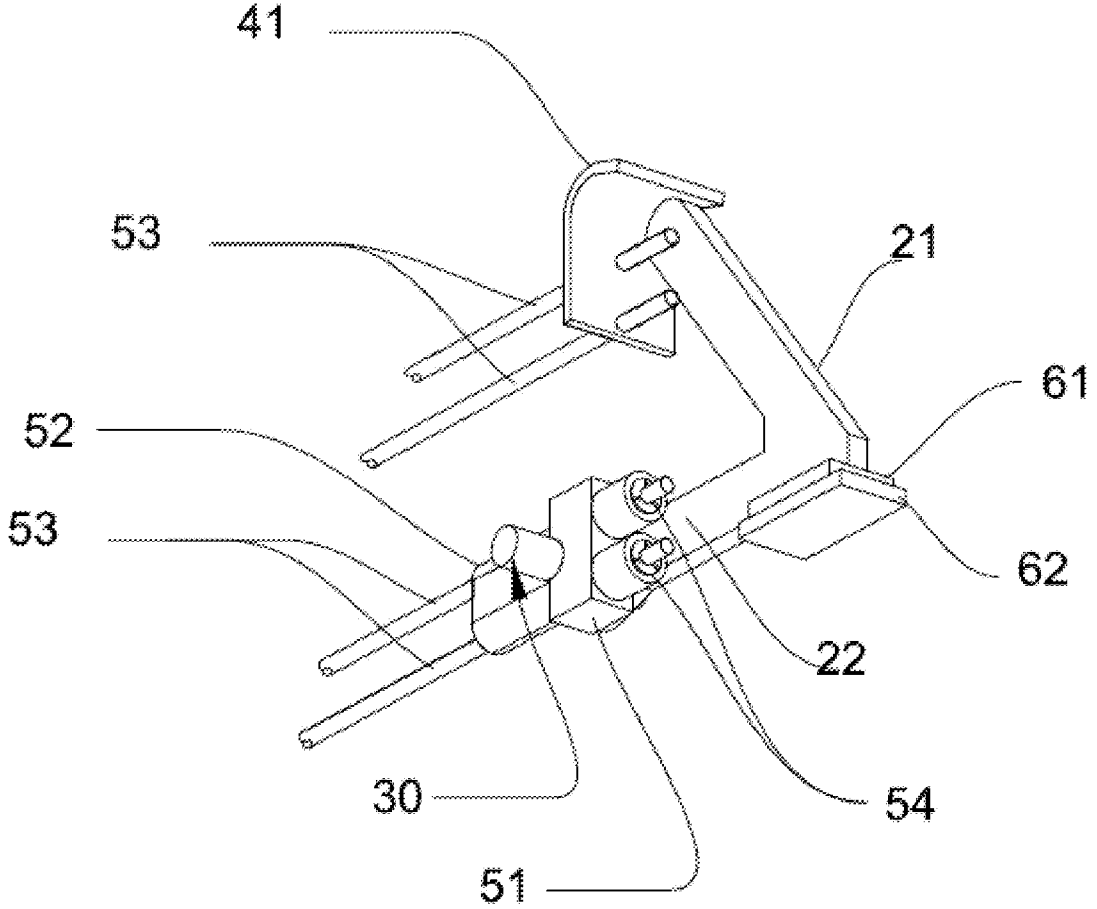
FIG. 10 shows a perspective view of the present invention without including the load-carrying and support members.
Figure 11A:
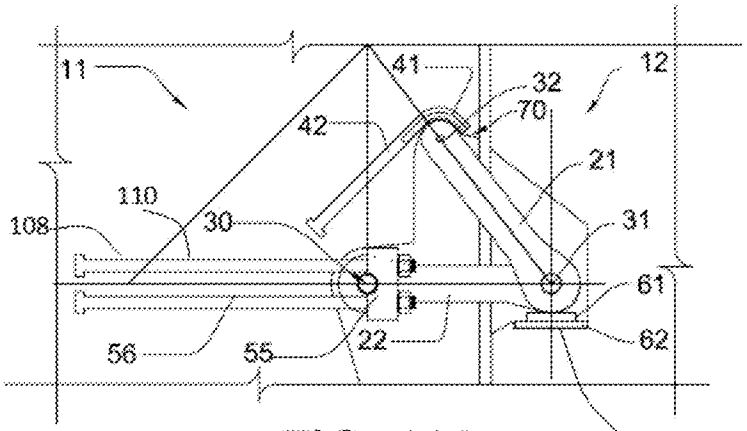
FIG. 11A and FIG. 11B show two cross sectional views of the present invention with an articulated strut-and-tie node, one of the cross sectional views depicts the movement of the struct-and-tie assembly between the stowed and extended positions.
Figure 11B:
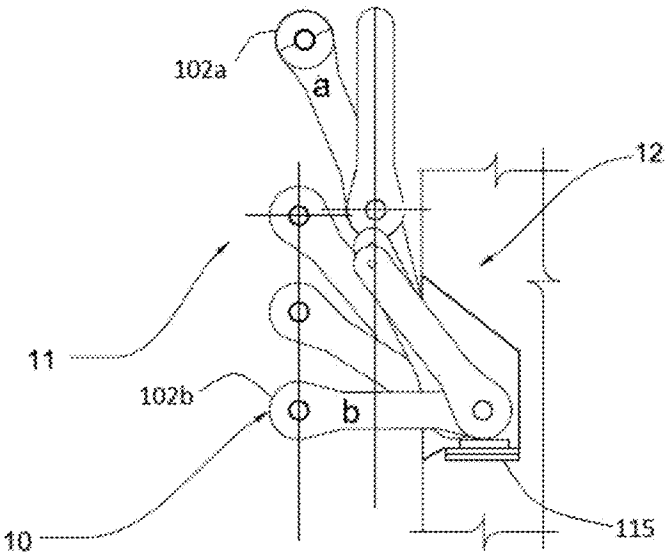
Figure 12A:
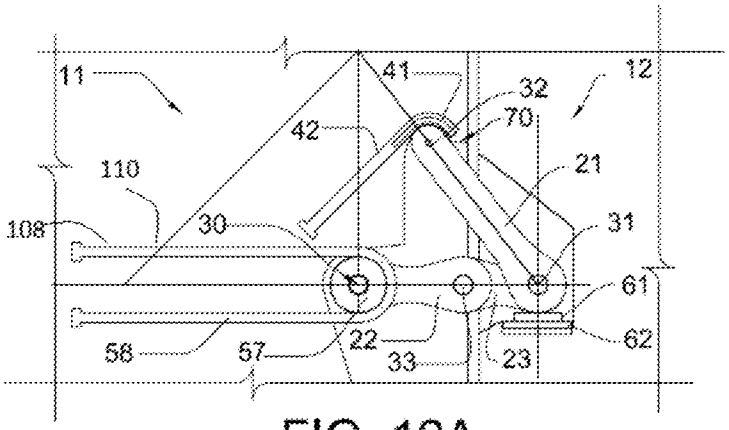
FIG. 12A and FIG. 12B show two cross sectional views of the present invention with an articulated strut-and-tie node and an articulated connector member, one of the cross sectional views depicts the movement of the struct-and-tie assembly between the stowed and extended positions.
Figure 12B:
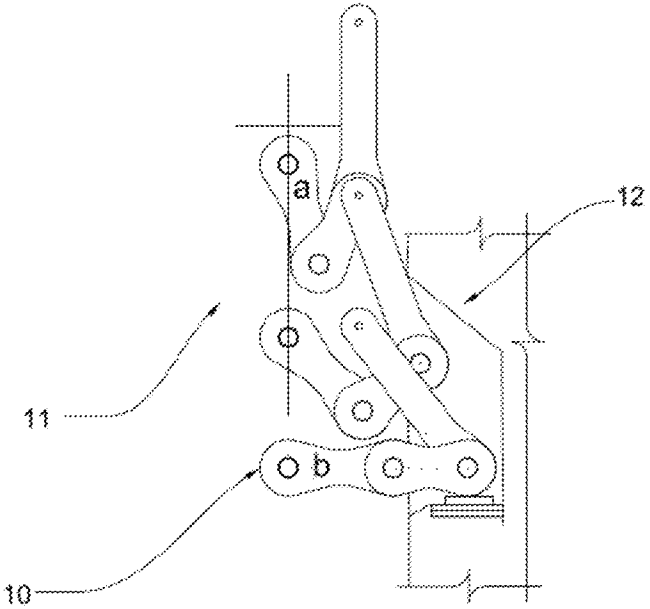

In an embodiment of the present invention, the load-carrying member 11 is made of a reinforced concrete material with a main tension reinforcement 108, the main tension reinforcement is made of a steel-based material, a composite material or both, the anchor assembly 50 mechanically connects to the main tension reinforcement 108.

In another embodiment of the present invention, the main tension reinforcement 108 comprises a prestressing steel reinforcement 109, either pretensioned, post-tensioned or both.

In another embodiment of the present invention, the prestressing steel reinforcement 109 comprises a strand member 53 carrying a load, the anchor assembly 50 has a barrel-wedge strand member chuck 54 coupled to a strand member yoke 51 with an integrated yoke seat 52, the barrel-wedge strand member chuck 54 grips the strand member 53 and transfers the load to the strand member yoke 51, the strand member yoke 51 transfers the load to the tie member 22 of the strut-and-tie assembly 20 through the rotatable member 30.

In another embodiment of the present invention, the main tension reinforcement 108 comprises a steel reinforcement 110.

In another embodiment of the present invention, the steel reinforcement 110 comprises a rebar 56 attached to a rebar yoke 55 integrated into the anchor assembly 50.

In another embodiment of the present invention, the steel reinforcement 110 comprises a flat bar 58 attached to a flat bar yoke 57 integrated into the anchor assembly 50.

In another embodiment of the present invention, the anchor end 104 of the tie member 22 comprises two parallel legs 105 with aligned circular apertures 106, a rotatable member 30 fixedly attached to the two parallel legs 105 passes through the aligned circular apertures 106 and the anchor assembly 50, the rotatable member 30 enables the articulated movement of the strut-and-tie assembly 20 between the stowed and extended positions (102*a*, 102*b*).

In another embodiment of the present invention, the rotatable member 30 is a pin.

In another embodiment of the present invention, the rotatable member 30 is a headed bolt.

In another embodiment of the present invention, the strut-and-tie node 107 is articulated as enabled by a strut-and-tie pin or a strut-and-tie headed bolt 31, a strut pin or a strut headed bolt 32 is installed at the bearing end 103 of the strut member 21 to safely secure the bearing end 103 to the load transfer assembly 40.

In another embodiment of the present invention, the tie member 22 connects to the strut member 21 at the articulated strut-and-tie node 107 through an articulated connector member 23 that extends from a pin-based articulation 33 in the tie member 22 to the articulated strut-and-tie node 107.

In another embodiment of the present invention, the bearing surface 114 is located in an open-ended cavity 116 formed in the support member 12, the open-ended cavity 116 is configured to accommodate the movement of the strut-and-tie assembly 20 between the stowed position 102*a* and the extended position 102*b*.

In another embodiment of the present invention, the strut member 21 has at least one strut stiffener 24 to increase the load-carrying capacity of the strut member 21.

In another embodiment of the present invention, the bearing surface 114 of the support member 12 is defined by a top surface 62*a* of an elastomeric bearing pad 62.

In another embodiment of the present invention, the bearing surface 114 of the support member 12 is defined by a top surface 61*a* of a steel bearing plate 61, the steel bearing plate 61 may be welded to the bearing section 60 of the strut-and-tie assembly 20.

In another embodiment of the present invention, the bearing surface 114 of the support member 12 is defined by a top surface 61*a* of a steel bearing plate 61 resting on an elastomeric bearing pad 62, the steel bearing plate 61 may be welded to the bearing section 60 of the strut-and-tie assembly 20, the elastomeric bearing pad 62 may rest on a masonry plate 115.

In another embodiment of the present invention, the load transfer assembly comprises a setting plate 41, a setting anchor rod 42, a compression concrete strut 43, a hair pin assembly 44, or any combination thereof.

In another embodiment of the present invention, a rope member access void former 70 that has an elongated body 72 and a bottom tip 71 is used to create an access path 70*a* for a rope member 111 to the deployable extender assembly 10 on the edge 101 of the load-carrying member 11, the rope member 111 is removably attached to the deployable extender assembly 10 on one end 112, the rope member 111 is actuated by an operator from another end 113 to move the deployable extender assembly 10 from the stowed position 102*a* to the extended position 102*b*.

In yet another embodiment of the present invention, the load-carrying member 11 is a beam, a lintel, a truss or a wall made of a concrete-based material, a metal-based material or a wood-based material, the support member 12 is a main beam, a column, a conventional wall or a tilt-up wall made of a concrete-based material, a metal-based material or a wood-based material.

An advantage of the present invention is that it enables the elimination or substantial reduction of eccentricity between the centroid of the bearing surface and the centroid of the support member. This reduces undesired flexural stresses in the support member, allowing the support member to be optimized for axial loading and leading to more efficient, economical structural design.

Another advantage of the present invention is that it enhances constructability by allowing the strut-and-tie assembly to move between a stowed position and an extended position. This movement facilitates easier installation in spatially constrained or geometrically complex construction environments, including retrofits and prefabricated systems.

Another advantage of the present invention is that it allows for integration with internal reinforcement within reinforced concrete members. By enabling mechanical connection to prestressing strands or steel reinforcement, the invention offers an alternative or supplementary load path that may improve performance in select applications.

Another advantage of the present invention is that it can be deployed using a rope-actuated mechanism, allowing the strut-and-tie assembly to be moved from its stowed to extended position even when direct manual access is restricted. This is especially beneficial in deep or enclosed structural zones where space or formwork makes access difficult.

Another advantage of the present invention is that it incorporates features such as pivot pins or headed bolts at key connection points, which provide stable and repeatable movement while simplifying assembly, disassembly, and maintenance during and after construction.

Another advantage of the present invention is that it can accommodate a variety of bearing configurations, including steel plates, elastomeric pads, or combinations thereof. This flexibility allows the system to be tailored to different load conditions, support materials, and structural tolerances.

Another advantage of the present invention is that it can be incorporated into a wide range of structural systems, including beams, lintels, trusses, and walls, and is compatible with load-carrying and support members made of concrete, steel, wood, or composite materials. This broad applicability makes the invention versatile across many building types and construction methods.

Still another advantage of the present invention is that it provides a structurally efficient and construction-friendly solution that combines optimized load transfer with deployment flexibility, thereby improving both structural performance and construction process reliability.

The embodiments of the deployable extender assembly for an edge of a load-carrying member of a structural system herein are exemplary and numerous modifications, combinations, variations, and rearrangements can be readily envisioned to achieve an equivalent result, all of which are intended to be embraced within the scope of the appended claims. Further, nothing in the above-provided discussions of the deployable extender assembly for an edge of a load-carrying member of a structural system should be construed as limiting the invention to an embodiment or a combination of embodiments. The scope of the invention is defined by the description, drawings, and claims.

What is claimed is:

1. A deployable extender assembly for an edge of a load-carrying member of a structural system to enhance performance and constructability of the structural system, the deployable extender assembly comprises:

a strut-and-tie assembly movable between a stowed position and an extended position, the strut-and-tie assembly has a strut member and a tie member connected at a strut-and-tie node, the strut member has a bearing end positioned against a load transfer assembly at the edge of the load-carrying member when the strut-and-tie assembly is in the extended position, the tie member has an anchor end articulately connected to an anchor assembly at an articulated connection that is fixedly secured to the edge of the load-carrying member, the articulated connection enables the strut-and-tie assembly to move between the stowed and extended positions, the strut-and-tie assembly defines a bearing section that rests on a bearing surface of a support member of the structural system in the extended position;

wherein the strut-and-tie assembly is moved from the stowed position to the extended position in proximity to the bearing surface; and wherein a centroid of the bearing surface is configured to align substantially with a centroid of the support member to substantially eliminate flexural stresses along the support member that result from eccentricity between the two centroids;

wherein the load-carrying member is made of a reinforced concrete material with a main tension reinforcement, the main tension reinforcement is made of a steel-based material, a composite material or both, the anchor assembly mechanically connects to the main tension reinforcement; and wherein the load-carrying member is made of a reinforced concrete material with a main tension reinforcement, the main tension reinforcement is made of a steel-based material, a composite material or both, the anchor assembly mechanically connects to the main tension reinforcement; and wherein the prestressing steel reinforcement comprises a strand member carrying a load, the anchor assembly has a barrel-wedge strand member chuck coupled to a strand member yoke with an integrated yoke seat, the barrel-wedge strand member chuck grips the strand member and transfers the load to the strand member yoke, the strand member yoke transfers the load to the tie member of the strut-and-tie assembly through the rotatable member.

2. A deployable extender assembly for an edge of a load-carrying member of a structural system to enhance performance and constructability of the structural system, the deployable extender assembly comprises:

a strut-and-tie assembly movable between a stowed position and an extended position, the strut-and-tie assembly has a strut member and a tie member connected at a strut-and-tie node, the strut member has a bearing end positioned against a load transfer assembly at the edge of the load-carrying member when the strut-and-tie assembly is in the extended position, the tie member has an anchor end articulately connected to an anchor assembly at an articulated connection that is fixedly secured to the edge of the load-carrying member, the articulated connection enables the strut-and-tie assembly to move between the stowed and extended positions, the strut-and-tie assembly defines a bearing section that rests on a bearing surface of a support member of the structural system in the extended position;

wherein the strut-and-tie assembly is moved from the stowed position to the extended position in proximity to the bearing surface;

wherein a centroid of the bearing surface is configured to align substantially with a centroid of the support member to substantially eliminate flexural stresses along the support member that result from eccentricity between the two centroids; and wherein a rope member access void former that has an elongated body and a bottom tip is usable to create an access path for a rope member to the deployable extender assembly on the edge of the load-carrying member, the rope member is removably attached to the deployable extender assembly on one end, the rope member is actuatable by an operator from another end to move the deployable extender assembly from the stowed position to the extended position.

* * * * *